US006080013A

United States Patent [19]

Bèland et al.

[11] Patent Number: 6,080,013

[45] **Date of Patent: *Jun. 27, 2000**

[54] ELECTRODE MOUNTING STRUCTURE

[75] Inventors: Robert Bèland, St. Marthe sur le Lac; Pascal Kaufmann, Ville de Deux Montagnes, both of Canada

[73] Assignee: Transfotec International LTEE, Quebec, Canada

[ * ] Notice: This patent issued on a continued prosecution application filed under 37 CFR 1.53(d), and is subject to the twenty year patent term provisions of 35 U.S.C. 154(a)(2).

[21] Appl. No.: 08/815,472

[22] Filed: Mar. 11, 1997

[51] Int. Cl.[7] ..... H01R 13/73

[52] U.S. Cl. ..... 439/571; 248/181; 220/3.3; 362/133

[58] Field of Search ..... 439/220, 226, 439/227, 234, 534, 535, 540.1, 538, 571, 573; 248/181; 220/3.3, 3.7, 3.9; 362/133, 216–225, 183, 184, 396

[56] References Cited

U.S. PATENT DOCUMENTS

| | | | |
|---|---|---|---|
| 1,654,350 | 12/1927 | Shelton . | |
| 1,804,525 | 5/1931 | Cadieux . | |
| 1,991,099 | 2/1935 | Katz | 439/226 |
| 3,550,298 | 12/1970 | O'Neill | 40/130 |
| 3,627,339 | 12/1971 | Burweger | 248/181 |
| 3,862,411 | 1/1975 | Persson | 240/25 |
| 3,919,798 | 11/1975 | Mutzhas | 40/130 |
| 3,965,597 | 6/1976 | Noellert | 40/130 |
| 4,434,569 | 3/1984 | Minogue | 40/545 |
| 4,511,200 | 4/1985 | Belokin, Jr. | 339/50 |
| 4,753,361 | 6/1988 | Medlin, Jr. | 220/3.3 |
| 5,178,449 | 1/1993 | Bauer | 362/133 |
| 5,209,674 | 5/1993 | Foster et al. | 439/235 |
| 5,239,129 | 8/1993 | Ehrenfels | 220/3.3 |
| 5,354,208 | 10/1994 | Salaski et al. | 439/230 |
| 5,528,477 | 6/1996 | Carmo | 362/260 |
| 5,735,703 | 4/1998 | Ballard | 439/234 |
| 5,768,814 | 6/1998 | Kozek et al. | 362/183 |

*Primary Examiner*—Steven L. Stephan
*Assistant Examiner*—Eugene G. Byrd
*Attorney, Agent, or Firm*—Wolf, Greenfield & Sacks, P.C.

[57] ABSTRACT

A universal mounting structure has receptacles for connection to a cold cathode tube. The structure has a mounting bracket which may be rotated about a longitudinal access of a receptacle housing, thus allowing mounting in any of a plurality of different configurations. The receptacle may include an electrical threaded connecter for an input signal to be received, the electrical threaded connector being aligned with the longitudinal access of the receptacle housing and providing a physical connection by which a mounting bracket may secure the receptacle housing to a mounting wall. The electrical threaded connector can also be used as a single attachment point for the receptacle. In another embodiment, the housing itself includes a flange extending from a plurality of faces of the housing to facilitate different mounting configurations.

21 Claims, 5 Drawing Sheets

ELECTRODE MOUNTING STRUCTURE

BACKGROUND OF THE INVENTION

1. Field of the Invention

This invention relates generally to a mounting structure for a component having electrodes, such as a cold cathode tubes used in illuminated advertising signs.

2. Discussion of the Related Art

Cold cathode tubes, also known as neon tubes or gas discharge devices, use an ionization process to provide light. Typically a vacuum-sealed glass tube is filled with an inert gas, such as argon or neon. The tube is fitted at each end with a metal electrode to provide an electrical contact with the contained gas. In operation, the metal electrodes are stimulated with a high-voltage alternating current (AC) source to initiate the ionization process, wherein the inert gas ions are stimulated, causing the tube to glow with light at a wavelength characteristic of the gas. For example, a neon tube glows ruby red, mercury vapor glows blue-green, and argon glows pale blue.

A cold cathode tube may be shaped (for example, letters and other shapes) to provide an illuminated advertising sign. AC power is typically provided by a transformer which converts a line voltage to a desired tube voltage, or by a DC-AC converter which converts a DC voltage to a desired tube voltage.

Existing mounting products for such tubes are specific to particular tube dimensions and electrode configurations. For example, one existing product has an enclosure with power receptacles opposite the mounting hardware, and thus may only be used with the cold cathode tube positioned opposite to a face of a wall to which the mounting hardware is fastened. However, if a different mounting arrangement is required, for example one in which the power receptacles are on the side of the enclosure adjacent to the mounting hardware, then a different part must be specified and procured.

It would be desirable if a more universal transformer and housing could be provided which allows multiple mounting arrangements.

SUMMARY OF THE INVENTION

One aspect of the present invention is directed to a more universal mounting apparatus having receptacles for connection to the electrodes of a cold cathode tube. In one embodiment, the apparatus includes a mounting bracket which may be rotated about a longitudinal axis of a receptacle housing, thus allowing mounting in any of a plurality of different configurations.

In particular, an apparatus for mounting a component having an electrode comprises a receptacle adapted to receive the electrode, a housing containing the receptacle, and a mounting bracket, coupled to the housing, the mounting bracket being rotatable about an axis of the housing to facilitate a plurality of mounting arrangements of the receptacle.

In another embodiment for mounting a cold cathode tube having an electrode, the apparatus comprises a housing containing a receptacle adapted to receive the electrode, and means for mounting the housing to a wall in a plurality of mounting configurations of the electrical receptacles with respect to the wall. The mounting means may include a means for rotating a mounting mechanism about a longitudinal axis of the housing.

Still further, a post may be mounted on the housing, wherein the mounting bracket is mounted on the housing via the post. The apparatus may further comprise an electrical connector adapted to receive an input signal, and the electrical connector may be mounted on the housing along the axis of the housing. The mounting bracket may also be coupled to the housing via the electrical connector. In one embodiment, the electrical connector has a threaded exterior to facilitate mounting of the apparatus to a wall by the electrical connector.

The apparatus may further comprise a post on a side of the housing, opposite to a side on which the connector is mounted, and a second bracket that couples the post to the housing. The bracket and the second bracket may each be fastened to a mounting wall. The apparatus may also further comprise a second receptacle that receives a second electrode of the component.

In another embodiment, the housing may include a plurality of flanges, each of which extends from a respective face of the housing, each of the plurality of flanges facilitating a different mounting configuration. The plurality of flanges may include a first flange extending from a first face of the housing, a second flange extending from a second face of the housing adjacent to the first face, a third flange extending from a third face of the housing adjacent to the second face, and a fourth flange extending from a fourth face of the housing adjacent to the third face and the first face.

Any of the above embodiments may further comprise a transformer mounted within the housing, and/or may form an illuminated letter sign.

BRIEF DESCRIPTION OF THE DRAWINGS

Other features and advantages of the present invention shall appear from the following description of an exemplary embodiment, said description being made with reference to the appended drawings, of which.

DETAILED DESCRIPTION

An illustrative embodiment of the invention is a mounting enclosure having receptacles for interfacing with electrodes of a cold cathode tube, the receptacles of the enclosure being positioned in any of a plurality of configurations. The plurality of configurations is facilitated by mounting brackets which may be rotated about an axis of the enclosure, or by a plurality of flanges on the enclosure.

Figure 1:
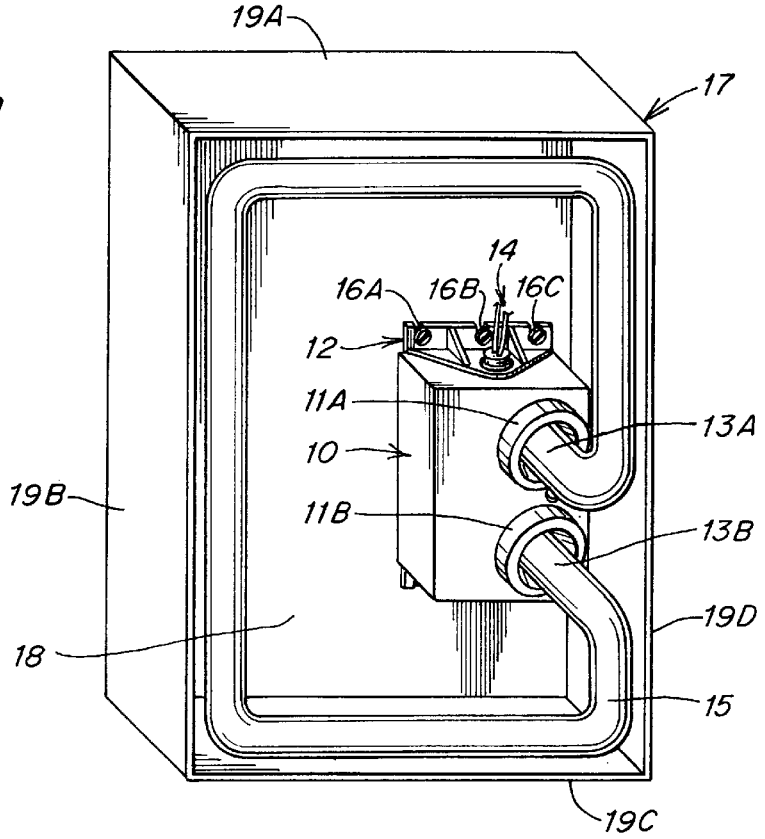
FIG. 1 is a perspective view of an embodiment of a mounting apparatus of the invention, installed in a letter channel with a cold cathode tube in place.

FIG. 1 is a perspective view of an enclosure 10 installed in a letter channel 17, with a cold cathode tube 15 mounted in the enclosure 10. The letter channel 17 in this example comprises a back panel 18, and several side walls 19A–D, arranged to form a box-like structure. The outer portion of each wall 19A–D extends outwardly from the back panel 18 to form a letter channel. When the cold cathode tube 15 is activated, the letter channel is illuminated. Other types of illumination tubes may be used in place of the cold cathode tube 12, depending upon the desired installation and electrical requirements.

The cold cathode tube 15 has two metal electrodes 13A and 13B, through which electrical power is received by the tube 15. The electrodes 13A and 13B also provide physical support for the tube 15, additional physical supports can be installed as desired. As shown in FIG. 1, the first electrode 13A is connected physically and electrically to a first receptacle 11A that is integral with the enclosure 10, and a second electrode 13B is connected physically and electrically to a second receptacle 11B that is integral with the enclosure 10.

The enclosure 10 is mounted via a bracket 12 and screws 13A–C to the back panel 18. Generally, back panel 18 is representative of any mounting face to which the enclosure 10 may be attached, and in some applications the enclosure 10 and tube 15 may be installed without a letter channel. In the mounting arrangement shown in FIG. 1, receptacles 11A and 11B are positioned on a side of the enclosure 10 that is opposite to the back panel 18 to which the enclosure 10 is mounted. Another bracket (not shown) is positioned on the side of the enclosure 10 that is opposite to the side upon which the first bracket 12 is mounted.

A wiring arrangement 14 protrudes from the enclosure to provide connections by which electrical power may be received by a transformer or power supply within the enclosure 10. The wiring arrangement 14 may receive AC line power such as 110 Volts AC, which may be desirable for commercial or residential installations of a letter channel or cold cathode tube without a letter channel. Alternatively, the connector 14 may receive a DC (direct current) voltage such as 12 Volts, which may be desirable for automotive installations. Such a transformer may also be referred to as a power supply. Additionally, the connector 14 may instead receive a low voltage, high frequency signal which may be stepped up by the transformer. In some applications, the enclosure may include a power source such as a battery, so that no external wiring arrangement 14 is necessary.

Figure 2:
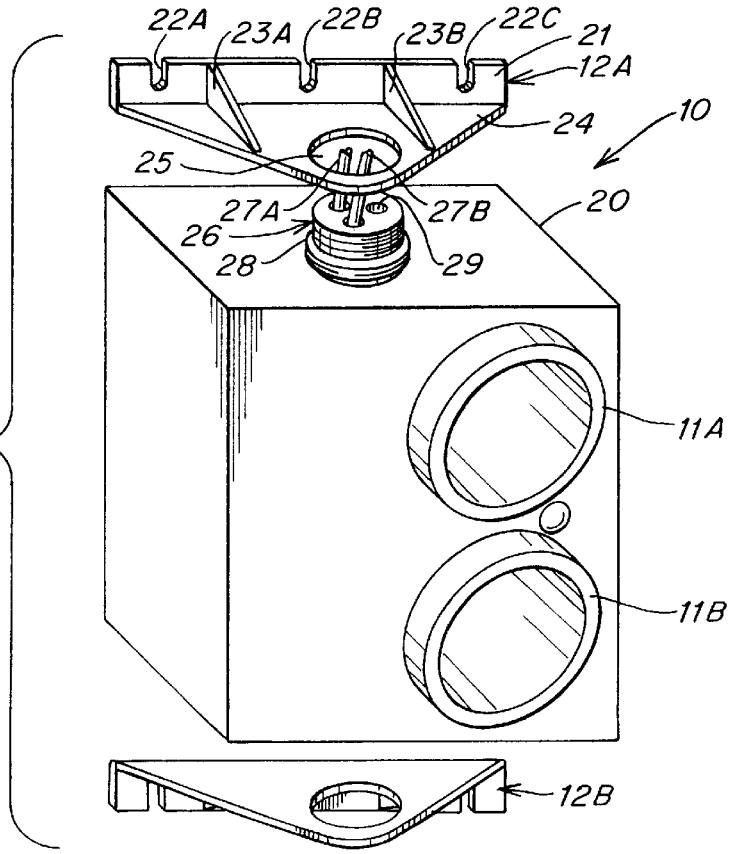
FIG. 2 is an exploded perspective view of an embodiment of a mounting apparatus, showing an enclosure and two brackets.

FIG. 2 is an exploded perspective view of an enclosure including a housing 20 and two brackets 12A and 12B. FIG. 2 shows bracket 12A as an L-shaped structure with a first face 24 that is parallel to the side of the enclosure 10 to which the bracket is attached, and a second face 21 that is perpendicular to the first face 24 and parallel to the mounting face to which the enclosure 10 is to be attached. Triangular support buttresses 23A and 23B provide additional structural support between the two faces 21 and 24. Additionally, the first face 24 has a hole 25 by which the housing 20 may be secured to a mounting face such as panel 18. The second face 21 of the bracket 12A also includes slots 22A, 22B, and 22C for attachment to the wall 18 by a screw or other fastener as may be appropriate.

Receptacles 11A and 11B are shown on the housing 20 in FIG. 2 without corresponding electrodes for clarity of FIG. 2. The receptacles 11A and 11B may include ceramic or porcelain as insulating material, as well as an electrical contact suitable for conducting electrical current.

Although FIG. 2 shows two receptacles 11A and 11B, at least one embodiment of the invention includes a housing with only a single receptacle. Such an embodiment may be used in conjunction with a second housing having a single receptacle, so that each of the two tube electrodes conduct current and are physically supported by a different mounting structure. This arrangement facilitates construction of a letter sign in which the electrodes of one tube are not in close proximity to one another (for example, several inches or several feet away), or in which a first electrode of one tube has a different mounting configuration than a second electrode of the same tube. For example, with reference to FIG. 1, the first electrode may be mounted facing into the back panel 18, while the second electrode may be mounted facing into the side wall 19D.

As shown in the embodiment of FIG. 2, connector 26 is mounted into the side of housing 20 to which the bracket 21A is to be physically connected. On the side of the housing 20 which is opposite to the side having bracket 21A attached, a post may be positioned by which the second bracket 21B is attached to the housing 10. This post is similar in physical configuration to the connector 26, and will be described further below.

In this embodiment, connector 26 has three holes for electrical connection. Wire 27A passes through one hole and wire 27B passes through a second hole of the connector 26. Together, wires 27A and 27B form the wiring arrangement 14 described with respect to FIG. 1. The third hole 29 within connector 26 provides for an optional ground wire (not shown). The connector 26 may also include a lip 28 which extends about the perimeter of the connector 26 to provide for a more secure attachment in the hole 25 of the bracket 12A. Connector 26 may also be threaded to allow attachment of the enclosure 10 to the wall 18 without the need for any brackets, as described in more detail below.

In at least one embodiment, the housing 20 is substantially square with respect to a longitudinal axis which passes through the connector 26, so that by positioning brackets 12A and 12B in different rotational configurations, the receptacles 11A and 11B may be mounted in several relative positions with respect to the panel 18. FIGS. 3–6 show several of the possible mounting positions.

Figure 3:
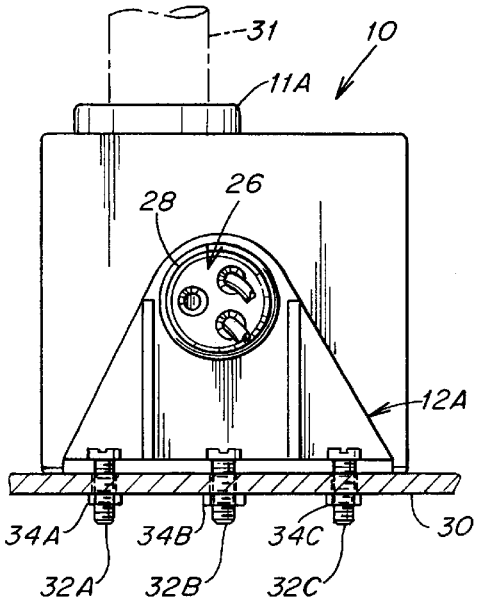
FIG. 3 shows an end view of this embodiment, in a first of four rotary positions.

In particular, FIG. 3 shows an end view of the enclosure 10 mounted to a mounting wall 30 in a first of four rotary positions. As shown in FIG. 3, the bracket 12A is mounted to the mounting wall 30 so that an electrode 31 of a cold cathode tube is positioned in a receptacle 11A that is opposite to the mounting wall 30. The bracket 21 has been slipped over the lip 28 of the connector 26 and then clamped to the mounting wall 30 by an arrangement of nuts and bolts. In particular, bolt 32A has been inserted through a slot of the bracket 12 and secured with a nut 34A. Bolts 32B and 32C have been respectively similarly secured with nuts 34B and 34C.

Figure 4:
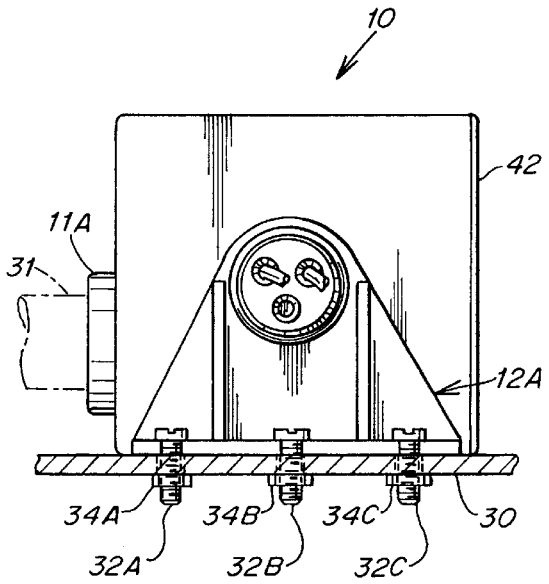
FIG. 4 shows an end view of this embodiment, rotated in a second of four rotary positions.

FIG. 4 shows the same end view as FIG. 3, but the enclosure 10 has been rotated ninety degrees counterclockwise to form a second of four rotary positions, and secured into place. Thus, in FIG. 4, the electrode 31 and receptacle 11A are parallel to the mounting wall 30 and face to the left of the enclosure 10. FIG. 4 also shows a cover 42 on a side of the enclosure opposite the receptacle 11A, which provides access to the internal of enclosure 10.

Figure 5:
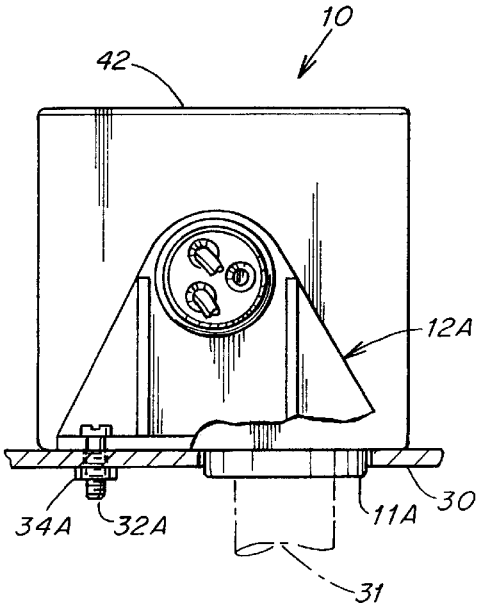
FIG. 5 shows an end view of this embodiment, rotated in a third of four rotary positions.

In FIG. 5, the enclosure 10 has been rotated an additional 90 degrees counterclockwise from the position shown in FIG. 4, to form a third rotary position. In this position, a hole or other passage may be formed through the mounting wall 30 so that the receptacle 11A and/or electrode 31 may pass through the mounting wall 30.

Figure 6:
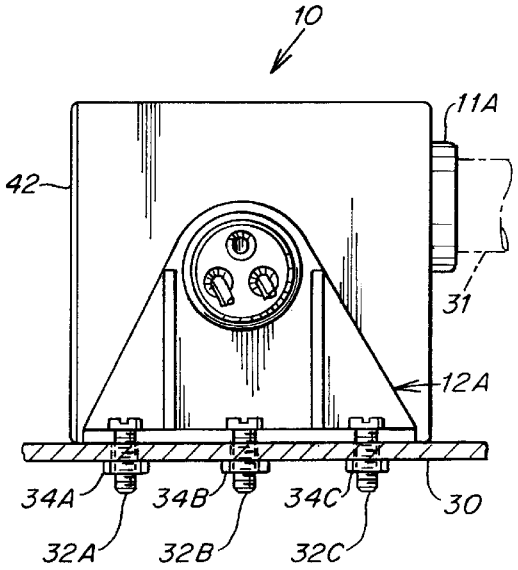
FIG. 6 shows an end view of this embodiment, rotated in a fourth rotary position.

FIG. 6 shows an end view, rotated ninety degrees from FIG. 5 and secured in a fourth rotary position. In this position, the electrode 31 and receptacle 11A are parallel to mounting wall 30 and face to the right of the enclosure 10.

Figure 7:
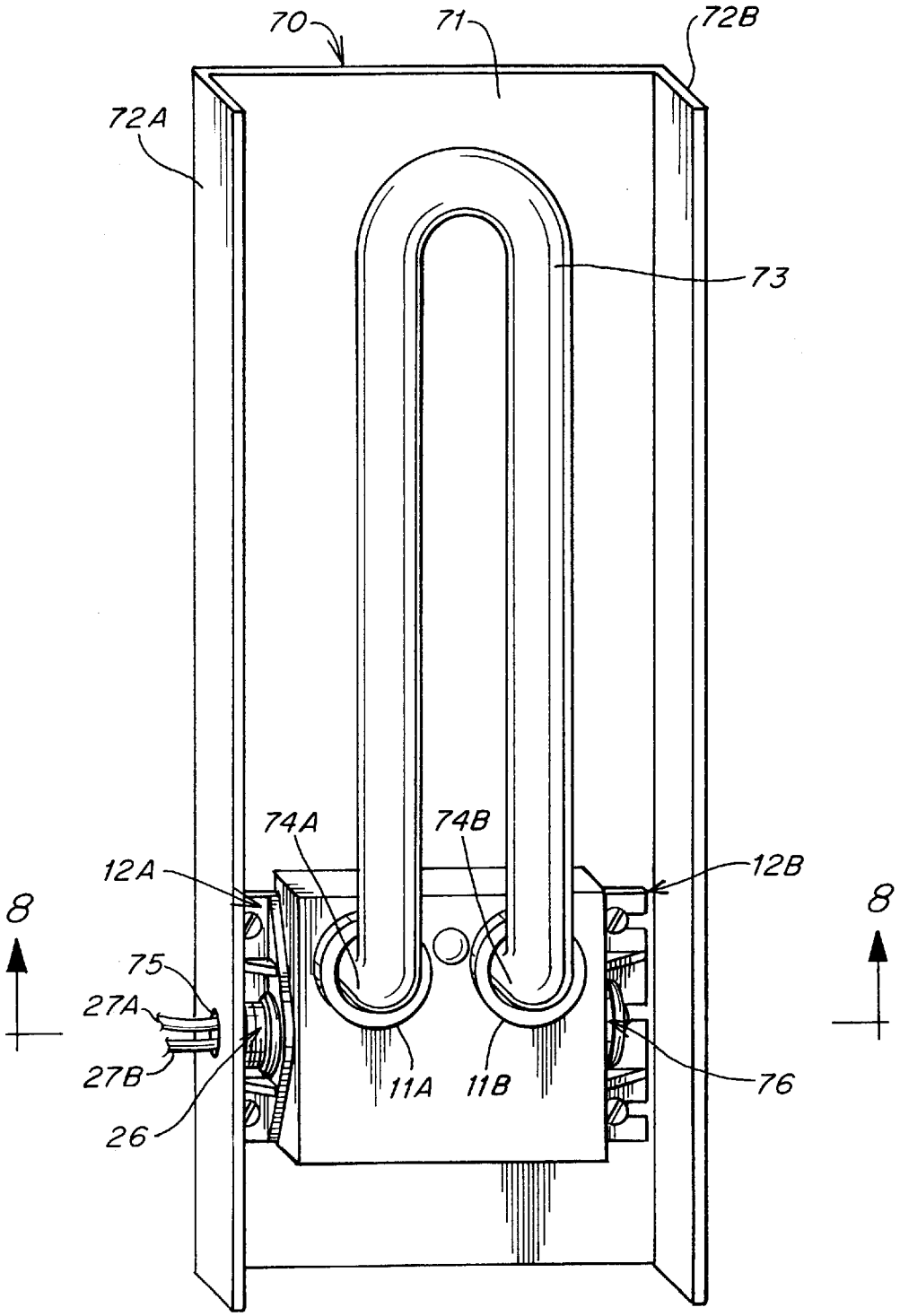
FIG. 7 is a perspective view of another embodiment of a mounting apparatus, installed in a vertical letter channel with a cold cathode tube in place.

FIG. 7 is a perspective view of an embodiment of the invention mounted in a vertical letter channel 70 with a cold cathode tube 73 having electrodes 74A and 74B respectively installed into receptacles 11A and 11B. The letter channel of FIG. 7 includes a back wall 71 which provides a mounting face for the enclosure 10, and two walls 72A and 72B mounted perpendicular to the back wall 71. A passage 75 has also been formed into the wall 72A to allow the wires 27A and 27B to be routed as desired from the connector 26. As shown in FIG. 7, the second bracket 12B may be mounted to post 76, which in turn is installed on the enclosure opposite to the connector 26.

Figure 8:
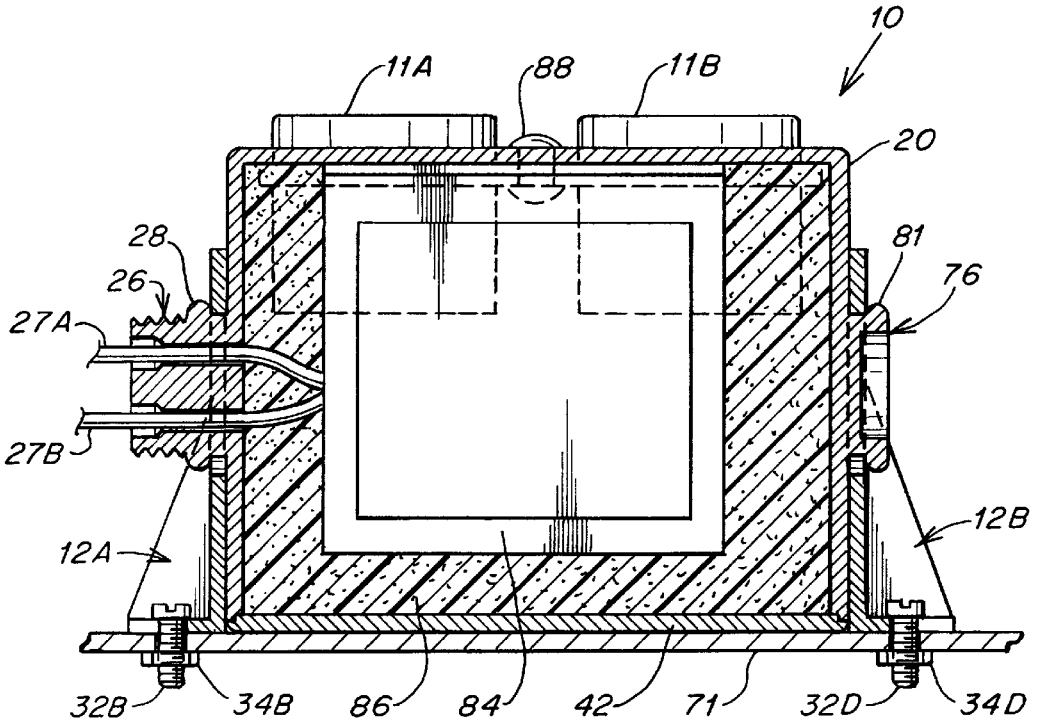
FIG. 8 is a cross-sectional side view taken along line 8—8 of FIG. 7.

FIG. 8 is a cross-sectional side view taken along line 8—8 of FIG. 7. This view shows a transformer 84 secured within the housing 20 of the enclosure 10. In particular, FIG. 8 shows an example of the transformer 84 being secured with a potting material 86, although other securing arrangements such as using screws or glue are also applicable. Wires from the transformer 84 to the receptacles 11A–B are not shown. FIG. 8 also depicts a fastener 88 that secures the assembly of receptacles 11A and 11B to the top side of housing 20.

FIG. 8 shows detail of the wiring holes within the connector 26, through which wires 27A–B pass. Additionally, a cross-sectional view of the lip 28 on the connector is shown in FIG. 8. Additionally, post 76 may have a lip 81 as shown in FIG. 8, for secure clamping by second bracket 12B. Bracket 12B may be connected to wall 71 by fasteners such as bolt 32D and nut 34D.

In other embodiments, in place of a transformer 84, any type of power supply (such as one with internal power) may be substituted, or a transformer that is a DC-AC converter.

Figure 9:
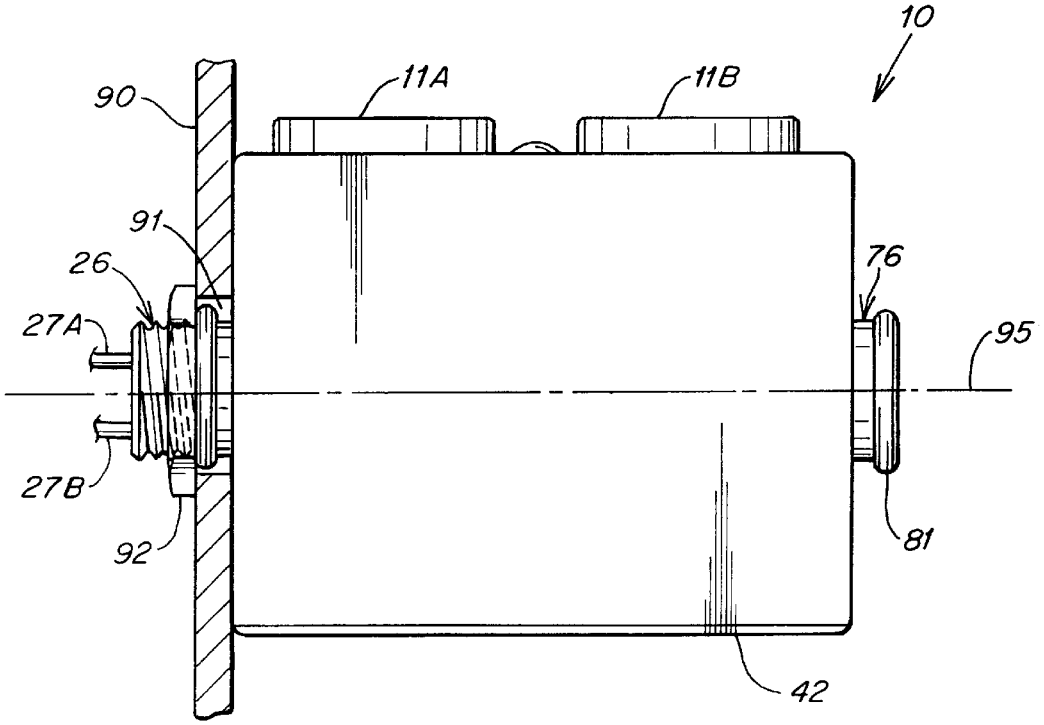
FIG. 9 is a side elevational view of an optional mounting arrangement using a threaded connector instead of brackets.

FIG. 9 is a side elevational view of an optional mounting arrangement by which the enclosure 10 is mounted to a wall 90 using the threaded connector 26. As shown in FIG. 9, brackets such as brackets 12A and 12B are not necessary, although they may provide additional support if an appropriate mounting face is available. In FIG. 9, the connector 26 has been positioned through a passage 91 in the mounting face 90, and secured via a nut 92 that has been tightened onto the threads of the threaded connector 26. This arrangement provides a relative position between the receptacles 11A–B and the mounting face 90 that is different from any shown in FIGS. 3–6.

In particular, the embodiment of FIG. 9 enables one of the receptacles 11A to be positioned between the mounting face 90 and the other receptacle 11B, instead of the two receptacles 11A–B being the same distance from a mounting face (as exemplified in FIGS. 3–6).

FIG. 9 also shows detail of the post 76 without the corresponding bracket 12B, as well as more detail of lip 81 formed about the circumference of post 76. In one alternative embodiment, a connector such as connector 26 may be used in place of post 76, although typically only one set of wires 27A–B is desired. In another alternative, post 76 may include threads such as the threads of connector 26. Each of these alternatives also allows the mounting of the post 76 through a wall in a manner similar to the manner in which connector 26 is mounted through the wall 90 in FIG. 9.

FIG. 9 also shows a longitudinal axis 95 about which the brackets 21 A–B may be rotated to form the arrangements of FIGS. 3–6.

Figure 10:
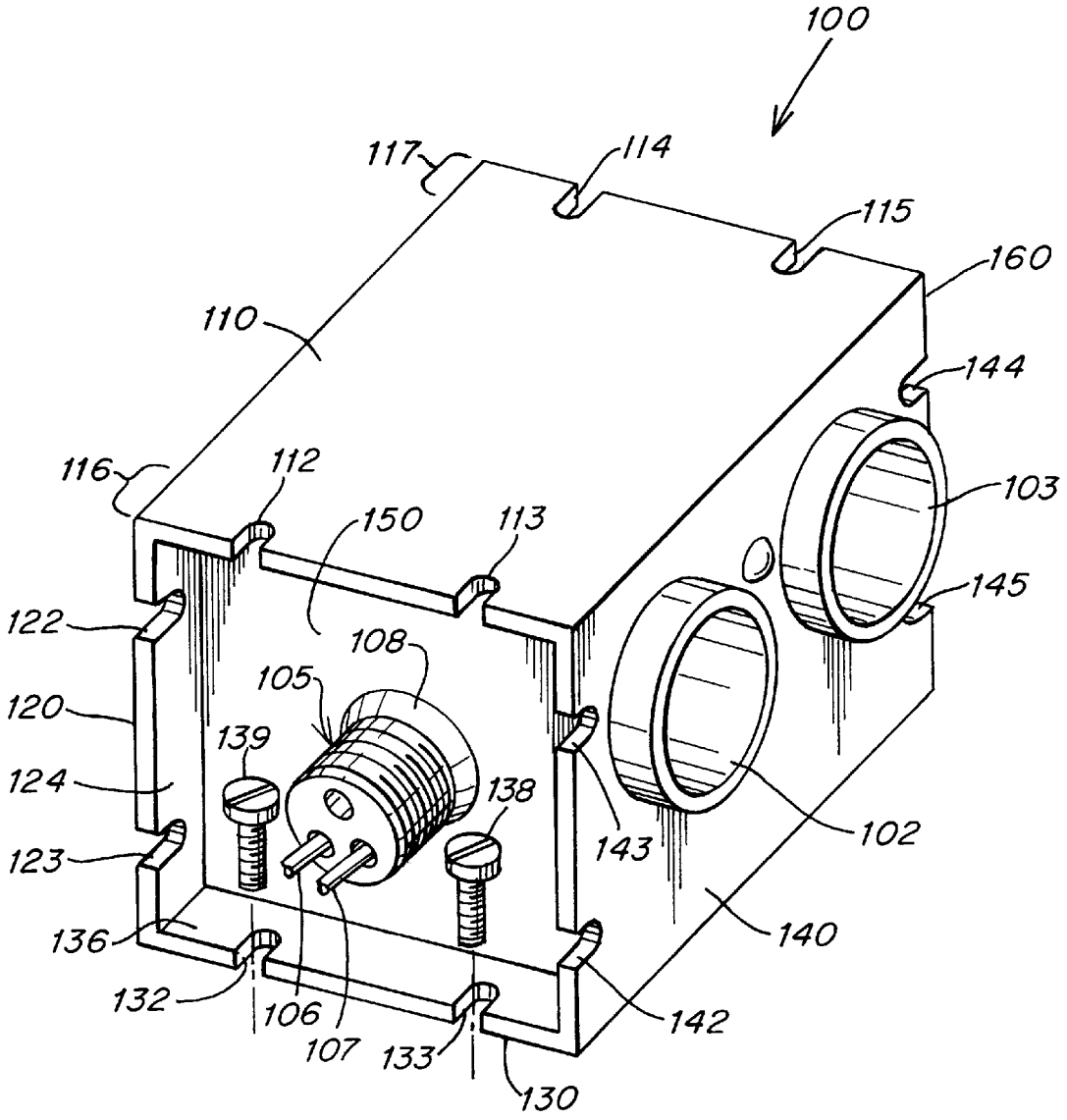
FIG. 10 is a perspective view of another embodiment of the invention.

FIG. 10 is a perspective view of another embodiment of the invention. In this embodiment, an enclosure 100 includes flanges extending from the enclosure that facilitate different mounting configurations.

The enclosure 100 of FIG. 10 has six sides 110, 120, 130, 140, 150, and 160 in a cube-like arrangement. Receptacles 102 and 103 are installed in side 140 for physical and electrical connection to a cold cathode tube. Additionally, connector 105 is installed in face 150 to receive an electrical power signal via wires 106 and 107. The connector 105 has a chamfer 108 instead of the enlarged lip 28 shown in earlier embodiments, although a connector such as connector 26 may also be used in this embodiment.

Side 110 has a flange 116 that extends beyond the connection of side 110 to side 150. On this flange, slots 112 and 113 provide a fastening mechanism to a mounting wall in one arrangement of the enclosure 100. Similarly, flange 117 of side 110 extends beyond the connection of side 110 to side 160, which is opposite to side 150. Flange 117 has slots 114 and 115 to provide additional mounting support when side 110 is to be positioned against a mounting wall. Similarly, side 120 has slots 122 and 123 positioned on a flange 124 extending from side 110, to provide a mounting arrangement that is ninety degrees rotated from the mounting arrangement provided by the slots of side 110.

Side 130, opposite to side 110, also has a flange 136 which extends beyond the connection of side 130 to side 110. As shown in FIG. 10, bolts 138 and 139 provide the fastening mechanism by which the enclosure 100 may be mounted to a mounting face such as a wall. In particular, bolt 138 slides through a slot 133 on flange 136, and bolt 139 slides though a slot 132 on flange 136.

Similarly, side 140 has slots 142, 143, 144, and 145 positioned to provide a fastening mechanism when the enclosure is mounted with the receptacles 102–103 against or through a mounting wall.

To install enclosure 100, any one of faces 110, 120, 130, or 140 may be selected to be positioned against a mounting wall, and then an appropriate fastening mechanism may be used through the corresponding slots. The enclosure need not be square because there are no mounting brackets required.

Having thus described several embodiments of the invention, various alterations, modifications, and improvements will readily occur to those skilled in the art. Such alterations, modifications, and improvements are intended to be within the spirit and scope of the invention. Accordingly, the foregoing description is by way of example only, and not intended to be limiting. The invention is limited only as defined in the following claims and the equivalents thereto.

What is claimed is:

1. An apparatus for mounting a gas discharge tube in multiple arrangements, the apparatus comprising:

at least one receptacle adapted to receive the gas discharge tube;

a housing including a transformer being mounted within the housing, and the housing including said at least one receptacle;

at least one electrical wire for conducting electrical current to the transformer; and a mounting bracket including a first part constructed for tight coupling of the mounting bracket to a mounting wall and a second part arranged for coupling to the housing, the second part of the mounting bracket including an opening arranged to receive the electrical wire and adjustably facilitate a plurality of stable mounting arrangements thereby facilitating a plurality of positions of the gas discharge tube.

2. The apparatus of claim 1, wherein the gas discharge tube illuminates an advertising sign.

3. The apparatus of claim 1, further comprising a post protruding from the housing, wherein the mounting bracket is mounted onto the housing via the post.

4. The apparatus of claim 1, further comprising an electrical connector adapted to receive an input signal, the electrical connector being mounted on the housing along an axis of the housing.

5. An apparatus for mounting a gas discharge tube, the apparatus comprising:

at least one receptacle adapted to receive the gas discharge tube;

a housing including said at least one receptacle and being attached to an electrical connector adapted to receive a wire providing electrical power to the gas discharge tube; and a mounting bracket including a first part and a second part, the second part being coupled to the housing via a threaded exterior surface the electrical connector in a rotatable arrangement that facilitates a plurality of orientations of said at least one receptacle thereby facilitating a plurality of positions of the gas discharge tube.

6. The apparatus of claim 5, further comprising:

a post on a side of the housing that is opposite to a side on which the connector is mounted; and a second-mentioned mounting bracket constructed for tight coupling to the mounting wall and cooperatively arranged with the mounting bracket to adjustably facilitate the plurality of mounting arrangements.

7. The apparatus of claim 6, wherein the mounting bracket and the second-mentioned mounting bracket are each fastened to a mounting wall.

8. The apparatus of claim 5, wherein the threaded exterior of the electrical connector in cooperation with the second part of the mounting bracket facilitates the plurality of positions of the gas discharge tube within a letter channel of an advertising sign.

9. The apparatus of claim 1, wherein said mounting bracket facilitates the plurality of positions of the gas discharge tube within a letter channel of an advertising sign.

10. The apparatus of claim 1, wherein said mounting bracket facilitates the plurality of rotatably adjustable positions of the gas discharge tube within a letter channel of an advertising sign.

11. The apparatus of claim 1, wherein the receptacle provides electrical contact to the gas discharge tube and physical support to the gas discharge tube.

12. An apparatus for mounting a gas discharge tube in multiple arrangements, the apparatus comprising:

a receptacle adapted to receive a gas discharge tube;

a housing including a transformer being mounted within and the receptacle;

a post-like structure extended from the housing; and at least one mounting bracket constructed to anchor the mounting bracket to a mounting wall and means for facilitating a plurality of stable mounting configurations of the housing by coupling to the post-like structure thereby facilitating a plurality of positions of the gas discharge tube with respect to the mounting wall.

13. The apparatus of claim 12, further comprising an electrical connector adapted to receive an input signal, the electrical connector being mounted on the housing about a longitudinal axis of the housing.

14. The apparatus of claim 13, wherein the electrical connector includes a threaded exterior cooperatively arranged with the mounting bracket to facilitate mounting of the housing.

15. The apparatus of claim 12, wherein the housing includes at least one flat surface and the mounting bracket is cooperatively arranged with the housing to position the flat surface in contact with the mounting wall to which the apparatus is attached.

16. The apparatus of claim 12, wherein the means for facilitating the plurality of mounting configurations includes means for rotating a mounting mechanism about a longitudinal axis of the housing.

17. An apparatus for mounting a cold cathode tube having an electrode, the apparatus comprising:

a receptacle adapted to receive the electrode of the cold cathode tube;

a housing including a transformer being mounted within the housing and containing the receptacle located at a face of the housing;

a first flange and a second flange including respective first and second mounting surfaces arranged for attachment to a mounting wall, said first and second flanges being attached to the housing so that the first and the second mounting surfaces are at an angle with respect to each other, the first flange and the second flange facilitating different stable mounting configurations of the housing and thereby facilitating a plurality of positions of the cold cathode tube.

18. The apparatus of claim 12, wherein the mounting wall is located within a letter channel of an advertising sign and the means for facilitating the plurality of mounting configurations includes two posts connected to the housing.

19. The apparatus of claim 18, wherein the plurality of flanges includes:

a first flange extending from a first face of the housing;

a second flange extending from a second face of the housing that is adjacent to the first face;

a third flange extending from a third face of the housing that is adjacent to the second face; and a fourth flange extending from a fourth face of the housing that is adjacent to the third face and the first face.

20. The apparatus of claim 18, in combination with the cold cathode tube and a mounting wall to which the apparatus is attached, to form an illuminated letter sign.

21. The apparatus of claim 18, wherein the apparatus further comprises a second-mentioned receptacle, contained by the housing, the second-mentioned receptacle being adapted to receive a second-mentioned electrode.

* * * * *